US005939678A

United States Patent [19]

Boyanich et al.

[11] Patent Number: 5,939,678

[45] Date of Patent: Aug. 17, 1999

[54] SCREW ON WIRE CONNECTOR

[76] Inventors: Joseph E. Boyanich, 16 Kaufman Rd., Cheektowaga, N.Y. 14225; George Honadle, 2358 Niagara Rd., Niagara Falls, N.Y. 14304

[21] Appl. No.: 08/892,160

[22] Filed: Jul. 14, 1997

Related U.S. Application Data

[63] Continuation-in-part of application No. 08/552,293, Oct. 2, 1995, abandoned.

[51] Int. Cl.[6] ..... H01R 4/02

[52] U.S. Cl. ..... 174/87

[58] Field of Search ..... 174/87, 78, 84 C; 403/396; 439/840

[56] References Cited

U.S. PATENT DOCUMENTS

| | | | |
|---|---|---|---|
| D. 315,143 | 3/1991 | Blaha | D13/149 |
| 1,736,379 | 11/1929 | Sommer | 174/87 |
| 2,589,368 | 3/1952 | Graham et al. | 174/87 |
| 2,790,962 | 4/1957 | Henderson . | |
| 2,792,444 | 5/1957 | Bergan | 174/87 |
| 2,823,249 | 2/1958 | Curtiss | 174/87 |
| 3,165,576 | 1/1965 | Lige | 174/87 |
| 3,183,472 | 5/1965 | Pawl . | |
| 3,614,296 | 10/1971 | Blomstrand | 174/87 |
| 3,676,574 | 7/1972 | Johansson et al. | 174/87 |
| 3,678,174 | 7/1972 | Ganzhorn | 174/87 |
| 3,875,324 | 4/1975 | Waddington et al. | 174/87 |
| 4,288,657 | 9/1981 | Swanson | 174/87 |
| 4,861,280 | 8/1989 | Piana et al. | 439/491 |
| 5,179,253 | 1/1993 | Munniksma et al. | 174/87 |
| 5,461,198 | 10/1995 | Delalle | 174/87 |
| 5,531,618 | 7/1996 | Market | 174/87 X |

*Primary Examiner*—Kristine Kincaid
*Assistant Examiner*—Chau N. Nguyen
*Attorney, Agent, or Firm*—Richard C. Litman

[57] ABSTRACT

A pigtailed screw on wire connector cap for connecting plural electrical appliances to a single device. The pigtailed screw on wire connector includes a basic screw on wire connector having an insulative cap thereon, and a flexible stranded wire lead extending from the screw on wire connector. The screw on wire connector has a substantially frustoconical cavity with distinct regions having varying diameters which are predominately threaded. The terminal region can have a limited or an extended space with or without any conducting surface. A contiguous region has a narrowed diameter. The next conductive region is conical with the largest diameter proximate to the opening of the cavity. The cylindrical region at the opening is nonconductive. The end of the soft stranded bare wire of the pigtail wire is crimped with a conductive sleeve and inserted into the terminal region where it is effectively confined during the subsequent twisting procedure. The load bearing wire is aligned with the pigtail wire proximate to the crimped sleeve, and splicing connection is made by twisting the cap to form a solid and dependable electrical connection between the pigtail wire and the load bearing wire. Various terminal connections can be attached to the pigtail wire to be compatible with the available connection.

20 Claims, 2 Drawing Sheets

SCREW ON WIRE CONNECTOR

BACKGROUND OF THE INVENTION

This application is a continuation-in-part of application Ser. No. 08/552,293, filed Oct. 2, 1995, now abandoned.

FIELD OF THE INVENTION

The present invention relates to a screw on wire connector comprising a plastic connector body containing a connector coil housing for making inexpensive, easy and quick electrical splices in wiring circuits. The inventive apparatus provides in two embodiments for spatial clearances of at least one pigtail wire to be fitted at the top center of the connector coil housing with a metal sleeve to hold the pigtail wire in place and free to turn. When one or more load bearing wire leads are inserted in the pigtail connector, the at least one pigtail wire is free to bond to the other wire leads by twisting the insulated cap and the wire connector coil housing to form a solid and dependable wire connection.

DESCRIPTION OF THE PRIOR ART

Electricians make electrical wiring splices when used to interrupt a circuit wire and add additional conductors from appliances or the like added to the existing line. Other splices are made when two or more appliances are being connected to a single switch, outlet or receptacle. Conventionally, when multiple appliances are being connected to a single device, an extra length of wire, i.e., a pigtail, must be fashioned to accommodate the splice. Typically, in conventional building wiring, the appliances have solid wire leads. The length of wire used as the pigtail is generally a soft stranded length of wire. Standard screw on wire connectors are conventionally known to have a plastic shell having a frustoconical shape with a metallic threaded interior.

The problem exists when mixed wire types are used in a splice, e.g., solid and stranded wire types. Conventional screw on wire connectors do not provide adequate anchoring of the different wire types. Consequently, a stranded wire pigtail in a solid wire splice requires an extra amount of effort to properly set the pigtail. The prior art is discussed in the order of their perceived relevance to the present invention.

U.S. Pat. No. 2,792,444, issued on May 14, 1957 to Martin D. Bergan, describes a pigtail connector that forms a splice of several conducting wires by joining with a cylindrical stamped copper sheet. The completed connection is press fitted into a bell-shaped insulative protective cover consisting of thermoplastic vinylite having a memory. There is no need for internal conductive threading of the pigtail connector.

U.S. Pat. No. 2,823,249, issued on Feb. 11, 1958 to Lawrence M. Curtiss, describes a snap-on plastic pigtail connector that is formed of two parts as an improvement on the Bergan invention. A male element with a metal crimpable sleeve is placed over two united leads and the sleeve is crimped. The closure cap is placed over the male element to engage with the locking groove on the male element to snap on and unite the parts. There is no need for adding internal metallized threadings.

U.S. Pat. No. 5,179,253, issued on Jan. 12, 1993 to Theodore Munniksma et al., describes a lighted wire connector as a testing assembly for detecting voltage in a circuit. A transparent cover houses a lamp connected to a current limit resistor and to the coiled spring inside the hollow plastic shell having external torquing wings and finger gripping means. A ground potential wire is attached to the lamp and leads outside the hollow shell. There is no need for a crimping band or two separate housing regions for the sleeve and the coil connector as in the present invention.

U.S. Pat. No. 2,790,962, issued on Apr. 30, 1957, to Wayne L. Henderson, describes an assembly for connecting and disconnecting a lead to a terminal. The insulating fastening member has a tapered bore lined with a coil spring which permits the electrical connection of an external lead without wrapping around the terminal stud. Applicant wraps leads to the pigtail wire.

U.S. Design Pat. No. 315,143, issued on Mar. 5, 1991, to William E. Blaha, describes a standard screw on wire connector with two external grooved base flanges which enable a better grip when uniting wires. FIG. 3 describes a serrated interior. There is no apparent disclosure of a conductive interior in this wire connector.

U.S. Pat. No. 3,183,472 issued on May 11, 1965, to Walter S. Pawl, describes a unitary rigid wire connector element in a block form which receives a plurality of wires lined up and breaks through their insulations to provide high pressure contacts between the connector element and each wire. This structure is another method of splicing, but dissimilar from the instant invention.

None of the above inventions and patents, taken either singly or in combination, is seen to describe the instant invention as claimed.

SUMMARY OF THE INVENTION

A distinctive pigtailed screw on wire connector is shown for connecting plural electrical appliances to a single device. The pigtailed screw on wire connector consists of a basic screw on wire connector having an insulative cap thereon, and a flexible stranded wire lead extending from the screw on wire connector. The screw on wire connector has a substantially frustoconical cavity with at least four distinct regions having varying threaded or unthreaded diameters. The first terminal region can have a limited space with a conducting coil periphery in the first embodiment or an extended space without a conducting coil periphery in the second embodiment. The second conductive region has a narrowed circular neck portion in the first embodiment but a cylindrical portion and a circular neck portion (a third region) in the second embodiment. The remaining regions in both embodiments are similar in that the frustoconical region is conductive, whereas the entrance region of the cavity is nonconductive.

The bare end of the soft stranded wire, preferably copper, of the pigtail wire is crimped with a conductive sleeve, preferably copper, and inserted into the first region where it is effectively confined during the subsequent twisting procedure. The load bearing wire is aligned with the pigtail wire proximate to the sleeve, and a splicing connection is made by twisting the cap to form a solid and dependable electrical connection between the pigtail wire(s) and the load bearing wire(s). Various terminal connecting means at the end opposite to the crimped end can be attached to a pigtail wire to conform with the available connection. A plurality of pigtail leads can be crimped together with the conductive sleeve. A plurality of solid wire leads can also be accommodated with the present invention.

Accordingly, it is a principal object of the invention to provide a screw on wire connector having a preformed pigtail for making electrical wiring splices.

It is another object of the invention to provide a screw on wire connector having a metal sleeve on the preformed pigtail.

It is a further object of the invention to provide a limited space within the screw on wire connector above the preformed pigtail lined with a conductive surface.

Still another object of the invention is to provide a screw on wire connector having an extended space with a nonconductive surface above the preformed pigtail.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
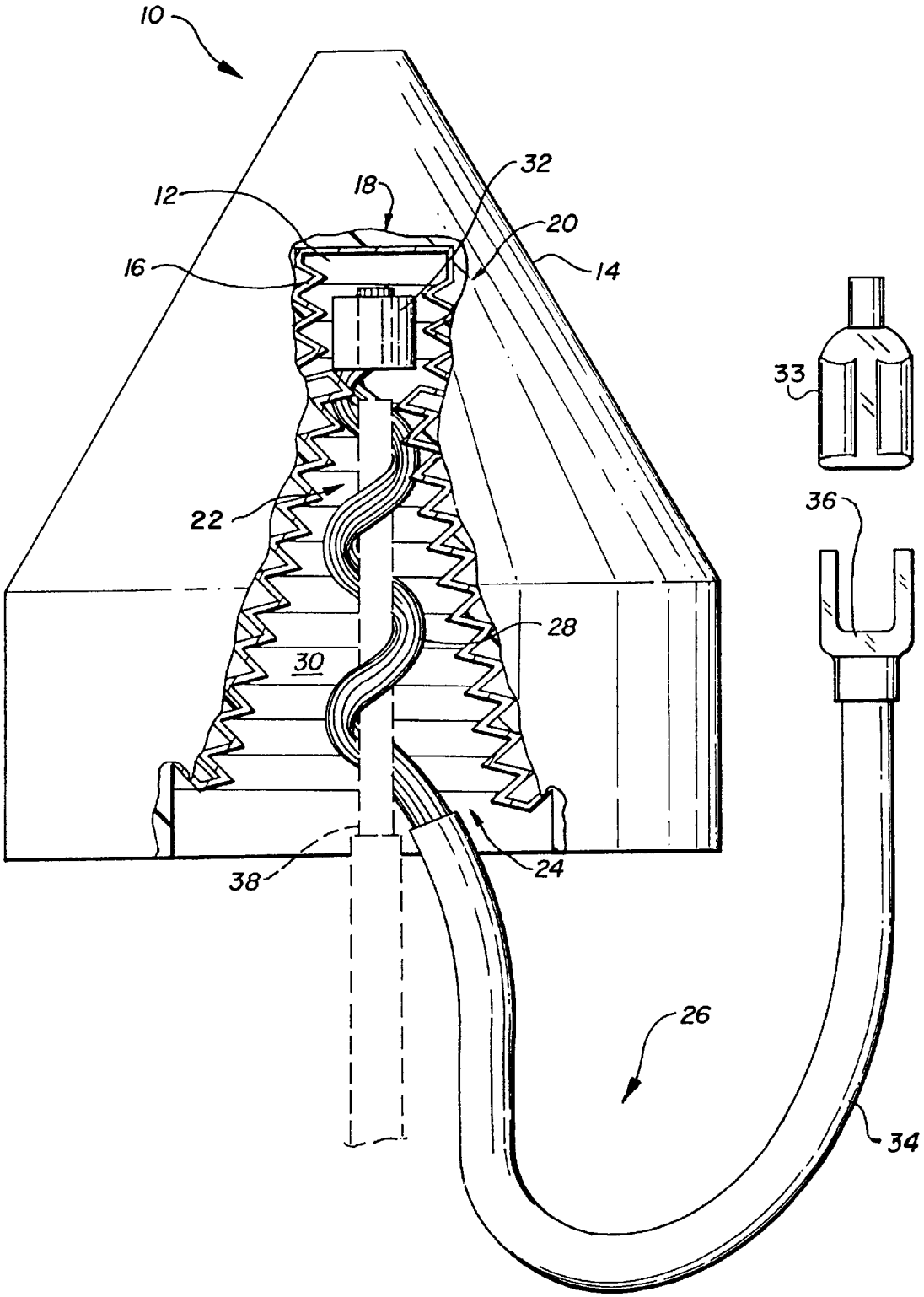
FIG. 1 is a side elevational view, partly in section, of a first embodiment of the present invention having a limited space completely lined with a conductive surface above the pigtail connector.

Referring to FIG. 1, a first embodiment of the screw on wire connector or wire nut device 10 of the present invention having a limited cylindrical headspace 12 for a wire connection is shown. The wire nut device 10 has a frustoconical plastic insulated cap 14, made of high tensile strength dielectric plastic. A wire nut insert or sleeve housing 16 (corrugated), preferably made of copper, substantially lines the matching corrugated inside surface of the cap 14 except for the headspace 12 and the cylindrical inlet region 24.

Four contiguous regions are formed in the cavity 30 of the cap 14. A first region 18 (headspace 12) has a conductive cylindrical surface. The second region 20 is a narrowed circular conductive neck. The third region 22 is a frustoconical conductive surface. The fourth region 24 (inlet), the entrance of the cavity, is cylindrical, nonconductive and has the largest diameter of the four contiguous regions.

A stranded pigtail wire lead 26 with an exposed or bare length of wire 28 commensurate in length with the depth of the cavity 30 has its end crimped by a metal wire sleeve 32 which is preferably soft copper. The pigtail wire lead 26 has an insulation 34 covering the wire from slightly within the insulated cap 14 to the end which is provided with a coupling 36. Although the coupling is depicted as a forked male connector, it can be of any suitable configuration such as a ring-type, a spade-type, a male-type, a female-type or even a bare wire. A female coupling connector 33 is shown in FIG. 1 to connect with the male coupling connector 36.

The bare portion of a main load bearing wire 38 (shown in shadow and usually solid copper) which is to be connected is placed adjacent to the bare stranded wire portion 28 of the pigtail wire lead 26, but spaced from the crimped sleeve 32. The insulated cap 14 is now placed over the wires and twisted relative to the wires to complete the electrical connection by twisting the pigtail wire lead 26 around the main load bearing wire 38.

It should be noted that a plurality of pigtail wire leads 26 and main load bearing wires 38 can be spliced together to form a common electrical node, but only one wire of each type is depicted as an example in the drawings. For larger wire bundles, larger size insulated caps 14 can be suitably employed. Since the crimped wire sleeve 32 is kept confined in the first region 18, twisting of the cap 14 around the wires creates a solid and dependable connection or splice.

Figure 2:
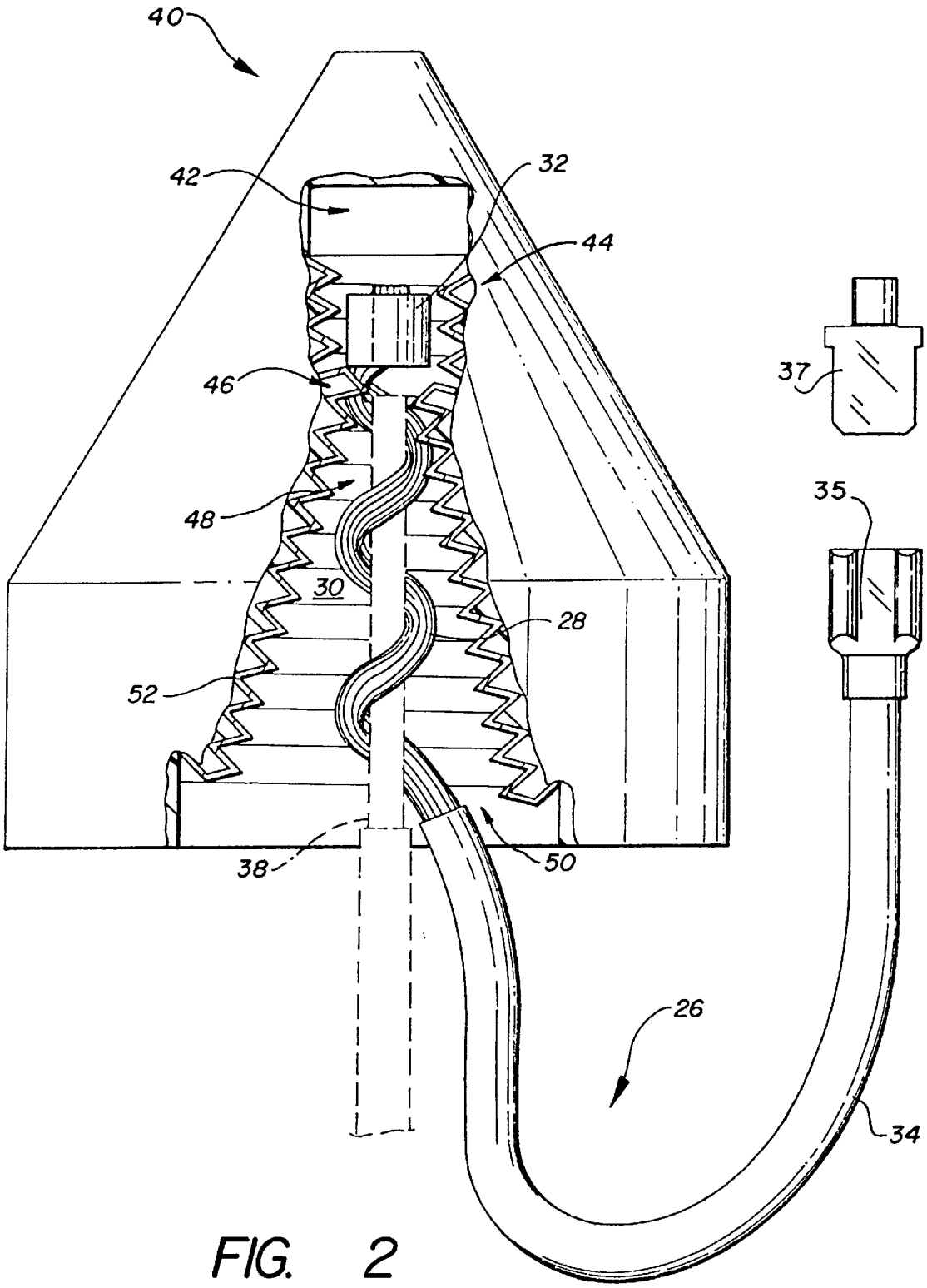
FIG. 2 is a side elevational view, partly in section, of a second embodiment of the present invention with a nonconductive extended surface above the pigtail connector.

Turning to FIG. 2, which is the second embodiment of the invention leading to a tighter, stronger compression bond of the pigtail wire lead 26 to the load bearing wire 38. The plastic wire nut device 40 comprises a first cylindrical and extended nonconductive region 42, a second cylindrical conductive region 44, a third cylindrical conductive region 46 with a reduced diameter, a fourth conductive region 48 having a frustoconical shape, and a fifth nonconductive region 50 forming an entrance of the cavity 30. The second, third and fourth regions form a continuous conductive sleeve housing or wire nut insert 52 which conforms to the inside surface configuration of the wire nut device 40. A female-type and spade-type connector 35 and a male-type spade connector 37 are shown.

In the twisting operation, the metal wire nut insert or sleeve housing 52 provides additional space for the crimped wire sleeve 32 and multiple wires being forced deeper in the first region 42 of the cavity 30 to result in an enhanced tight and strong compression bond. Consequently, FIGS. 1 and 2 provide the flexibility of a cylindrical region at a terminal end of the cavity 30 having a surface selected from a conductive surface (first region 18, FIG. 1) and a partially conductive surface (first and second regions, 42 and 44, FIG. 2).

As noted above, the cap 14 can support one or more pigtails and one or more load bearing wires. The number of pigtail wire leads 26 crimped together varies according to the needed application, and preferably up to six pigtail wire leads 26 would be accommodated.

The pigtailed screw on wire connector or wire nut devices 10 and 40 are used primarily for connecting plural appliances to an electrical device, for example, a single pole switch used to turn on and off multiple lights in a room. The screw on wire connector couples the multiple lights to a single switch by attaching the pigtail wire lead 26 to the switch. A decided advantage of the present invention is that less screw on wire connectors can be used, thus allowing more workable space in a conventional connection box.

It is to be understood that the present invention is not limited to the embodiments described above, but encompasses any and all embodiments within the scope of the following claims.

We claim:

1. A screw on connector cap device for electrical wire splicing of at least one pigtail wire to at least one load bearing wire comprising:

an insulative screw on wire connector cap having a substantially frustoconical cavity with regions for receiving a plurality of electrical wire ends to form a common electrical node; said regions including a cylindrical region at a terminal end of the cavity having a surface selected from a conductive surface and a partially conductive surface;

a circular conductive region with a reduced diameter;

a conductive region have a frustoconical shape, wherein said conductive regions constitute a conductive sleeve housing; and a nonconductive cylindrical region forming an entrance of the cavity;

at least one soft stranded pigtail wire with a crimped metal sleeve at an end of a bared wire portion, said at least one pigtail wire and sleeve located in the conductive sleeve housing, and said at least one pigtail wire extending outside the screw on wire connector cap having a covering insulation and a terminal connecting means; and at least one load bearing wire aligned with the at least one pigtail wire, proximate to the crimped metal sleeve and extending from said screw on wire connector cap;

wherein secure electrical connection to the at least one load bearing wire in the screw on wire connector cap is made by said at least one electrical pigtail wire being twisted around the at least one load bearing wire and extending from said screw on wire connector cap.

2. The device according to claim 1, wherein the insulative screw on wire connector cap is made of a dielectric plastic.

3. The device according to claim 1, wherein the pigtail wire comprises a core of soft stranded copper.

4. The device according to claim 1, wherein said at least one pigtail wire comprises up to six pigtail wires which are spliced to the at least one load bearing wire.

5. A screw on connector cap device for electrical wire splicing of at least one pigtail wire to at least one load bearing wire comprising:

an insulative screw on wire connector cap having a substantially frustoconical cavity with four regions for receiving a plurality of electrical wire ends to form a common electrical node; said regions including a first cylindrical region at a terminal end of the cavity having a conductive surface;

a second circular conductive region with a reduced diameter;

a third conductive region having a frustoconical shape, wherein said first, second and third regions constitute a conductive sleeve housing; and a fourth nonconductive cylindrical region forming an entrance of the cavity;

at least one soft stranded pigtail wire with a crimped metal sleeve at an end of a bared wire portion, said at least one pigtail wire and sleeve located in the conductive sleeve housing, and said at least one pigtail wire extending outside the screw on wire connector cap having a covering insulation and a terminal connecting means; and at least one load bearing wire aligned with the at least one pigtail wire, proximate to the crimped metal sleeve and extending from said screw on wire connector cap;

wherein secure electrical connection to the at least one load bearing wire in the screw on wire connector cap is made by said at least one electrical pigtail wire being twisted around the at least one load bearing wire and extending from said screw on wire connector cap.

6. The device according to claim 5, wherein said at least one pigtail wire comprises up to six pigtail wires which are spliced to the at least one load bearing wire.

7. The device according to claim 5, wherein said terminal connecting means is a fork-type terminal.

8. The device according to claim 5, wherein said terminal connecting means is a spade-type terminal.

9. The device according to claim 5, wherein said terminal connecting means is a male-type terminal.

10. The device according to claim 5, wherein said terminal connecting means is a female-type terminal.

11. The device according to claim 5, wherein said terminal connecting means is a section of bare wire.

12. A screw on connector device for electrical wire splicing of at least one pigtail wire to at least one load bearing wire comprising:

an insulated screw on wire connector cap having a substantially frustoconical cavity with the five regions for receiving a plurality of electrical wire ends to form a common electrical node; said regions including a first cylindrical region at a terminal end of the cavity having a nonconductive surface;

a second cylindrical conductive region;

a third cylindrical conductive region with a reduced diameter;

a fourth conductive region having a frustoconical shape, said second, third and fourth regions constituting a conductive sleeve housing; and a fifth nonconductive cylindrical region forming an entrance of the cavity;

at least one soft stranded pigtail wire having a crimped metal sleeve at an end of a bared wire portion, said at least one pigtail wire and sleeve located in the conductive sleeve housing, and said at least one pigtail wire extending outside the screw on wire connector cap having a covering insulation and a terminal connecting means, and at least one load bearing wire aligned with the at least one pigtail wire, proximate to the crimped metal sleeve and extending from said screw on wire connector cap;

wherein secure electrical connection to the at least one load bearing wire in the screw on wire connector cap is made by said at least one electrical pigtail wire being twisted around the at least one load bearing wire and extending from said screw on wire connector cap.

13. The device according to claim 12, wherein said at least one pigtail wire comprises up to six pigtail wires which are spliced to the at least one load bearing wire.

14. The device according to claim 12, wherein said terminal connecting means is a fork-type terminal.

15. The device according to claim 12, wherein said terminal connecting means is a spade-type terminal.

16. The device according to claim 12, wherein said terminal connecting means is a male-type terminal.

17. The device according to claim 12, wherein said terminal connecting means is a female-type terminal.

18. The device according to claim 12, wherein said terminal connecting means is a section of bare wire.

19. The device according to claim 12, wherein the insulative screw on wire connector cap is made of a dielectric plastic.

20. The device according to claim 12, wherein the pigtail wire comprises a core of soft stranded copper.

* * * * *